US007234967B2

(12) United States Patent
Weidner et al.

(10) Patent No.: US 7,234,967 B2
(45) Date of Patent: Jun. 26, 2007

(54) MULTI-PORT RF CONNECTOR

(75) Inventors: Kevin Edward Weidner, Hummelstown, PA (US); Michael J. Phillips, Camp Hill, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/273,793

(22) Filed: Nov. 15, 2005

(65) Prior Publication Data

US 2007/0111596 A1 May 17, 2007

(51) Int. Cl.
*H01R 0/05* (2006.01)

(52) U.S. Cl. ..... 439/581

(58) Field of Classification Search ..... 439/535, 439/581; 174/66, 67, 63, 579
See application file for complete search history.

(56) References Cited

U.S. PATENT DOCUMENTS 4,273,407 A * 6/1981 Snuffer et al. ..... 439/579
4,583,807 A * 4/1986 Kaufman et al. ..... 439/83
4,690,479 A * 9/1987 Hollyday et al. ..... 439/97
4,698,025 A 10/1987 Silbernagel et al.
4,895,521 A * 1/1990 Grabbe ..... 439/63
4,900,258 A * 2/1990 Hnatuck et al. ..... 439/63
5,719,753 A * 2/1998 Taylor ..... 361/812
5,879,166 A * 3/1999 Wang ..... 439/63
6,106,304 A * 8/2000 Huang ..... 439/63
6,132,244 A * 10/2000 Leeman et al. ..... 439/541.5
6,190,210 B1 2/2001 Belopolsky et al.
6,341,961 B1 * 1/2002 Juntwait ..... 439/63
6,358,062 B1 * 3/2002 Feldman et al. ..... 439/63
6,468,089 B1 * 10/2002 Hubbard et al. ..... 439/63
6,955,564 B2 * 10/2005 Cho et al. ..... 439/581

* cited by examiner

*Primary Examiner*—Tulsidas C. Patel
*Assistant Examiner*—Harshad C Patel

(57) ABSTRACT

A low profile connector assembly includes a conductive shell defining multiple interface ports and solderable surfaces configured to be surface mounted to a circuit board, and a center contact pin located in each respective interface port, wherein the center contact pin is substantially coplanar with the solderable surface. Integrally assembled mechanical fasteners reduce installation time and cost of the connector.

10 Claims, 5 Drawing Sheets

MULTI-PORT RF CONNECTOR

BACKGROUND OF THE INVENTION

The invention relates generally to electrical connectors, and more particularly, to coaxial connectors.

Coaxial connectors for interconnecting electrical components typically include a conductive signal path and a conductive shield surrounding the signal path. The conductive shield provides a return path through the connector and also prevents radio frequency (RF) leakage from the signal path. Sometimes referred to as RF connectors, coaxial connectors are used with and are employed in a wide variety of electrical and electronic devices and packages. Conventional RF connectors, however, are disadvantaged in several aspects.

For example, and like other electrical connectors and components, the increasing miniaturization of modem devices has rendered known coaxial connectors unsuitable for use in smaller and smaller devices and electronic packages. A number of discrete connectors, such as right angle, through-hole, or surface mount RF connectors, are typically positioned on a top surface of a circuit board and each connector extends entirely above the top surface of the board. The connector height profile, however, inhibits effective space management in the internal space of a device.

As another example, conventional RF connectors sometimes require special processing and fixturing to hold the connector in place while they are soldered to a circuit board, adding to the cost of installing the connectors to the board. Additionally each discrete connector typically must be separately installed and secured to the board and/or a panel connected to a supporting chassis of a device. Installing large numbers of connectors one at a time can be time intensive and expensive, and effectively limits the density of connectors on the board as some spacing between the connectors is required for installation.

Still further, obtaining optimum signal transmission in some types of RF connectors, particularly right angle connectors, has been difficult to achieve due to impedance matching problems in the right angle geometry of the connector.

BRIEF DESCRIPTION OF THE INVENTION

In one embodiment, a connector assembly comprises a conductive shell defining multiple interface ports and a solderable surface configured to be surface mounted to a circuit board, and a center contact pin located in each respective interface port, wherein the center contact pin is substantially coplanar with the solderable surface.

Optionally, the shell may comprise at least one mounting guide pin projecting substantially perpendicular to an axis of the center contact pins. The shell may include a front face and a rear face, with the rear face having a stepped contour dimensioned to receive an edge of the circuit board. At least one mechanical fastener may be integrally assembled into the shell. The shell may comprise a panel mounting flange, and at least one mounting aperture formed in the flange. The interface ports may be coaxial connector ports.

In another embodiment, a low profile connector assembly comprises a conductive shell comprising opposing front and rear faces, and-solderable surfaces configured to be surface mounted to a circuit board with the solderable surfaces extending incompletely between the front and rear faces. Multiple coaxial interface ports extend from the shell, and each of the ports comprise a center contact pin and a dielectric surrounding a portion of the pin. The center contact pins are substantially coplanar to the solderable surfaces.

In another embodiment, a low profile coaxial connector assembly comprises a circuit board having a top surface and a side edge, the top surface having a plurality of solder pads adjacent the side edge. A conductive shell is configured to receive the side edge of the circuit board, and the shell comprises opposing front and rear faces, and solderable surfaces configured to be surface mounted to the top surface of the circuit board. The solderable surfaces extend incompletely between the front and rear faces, and multiple coaxial interface ports extend from the shell. Each of the ports comprise a center contact pin and a dielectric surrounding a portion of the pin, and the coaxial interface ports extend axially and outwardly from the side edge of the circuit board without utilizing right angle geometry to establish electrical connection to the solder pads.

DETAILED DESCRIPTION OF THE INVENTION

Figure 1:
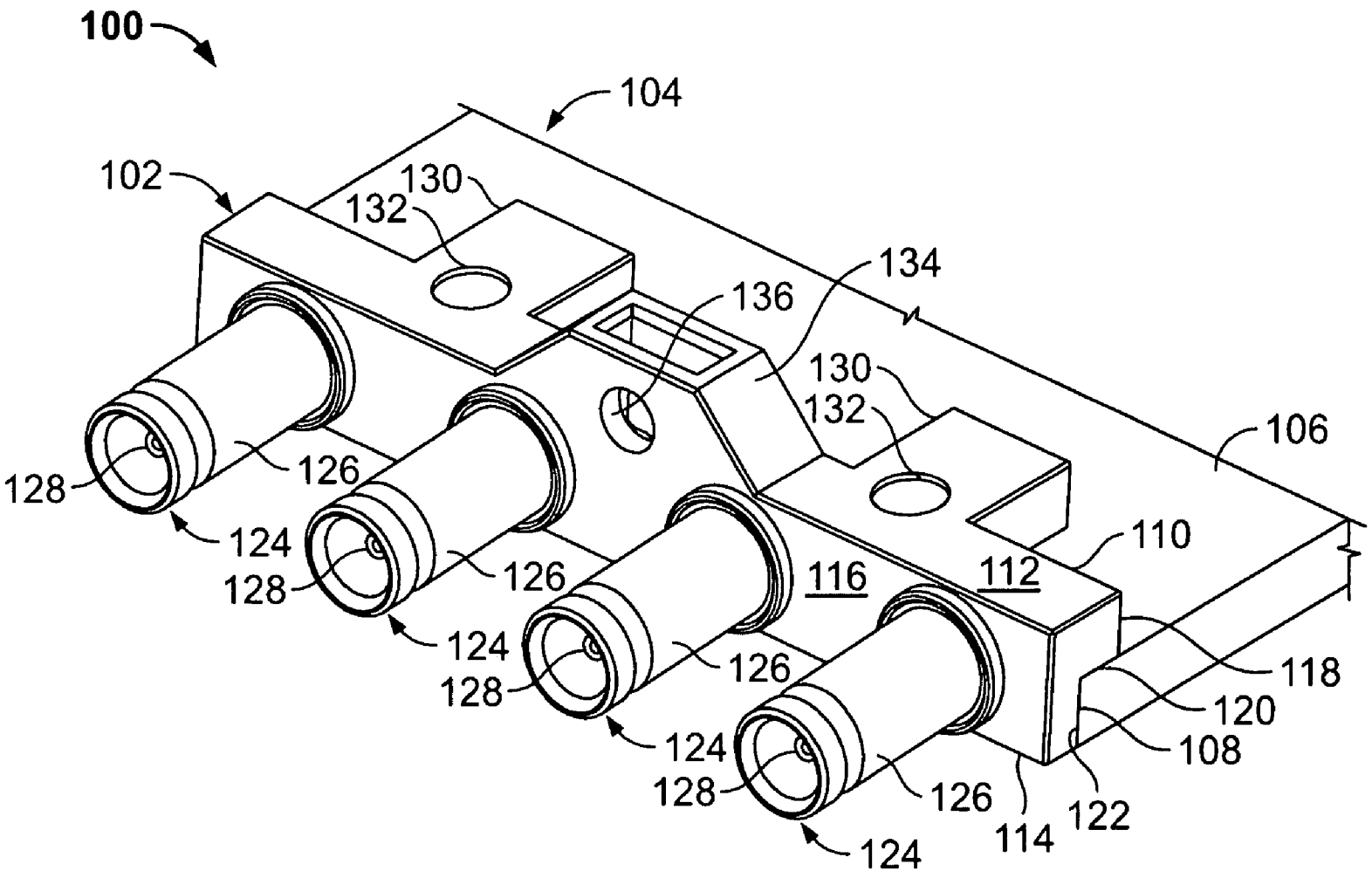
FIG. 1 is a top perspective view of a connector assembly formed in accordance with an exemplary embodiment of the present invention.

FIG. 1 is a top perspective view of a connector assembly 100 formed in accordance with an exemplary embodiment of the present invention. The assembly 100 includes a multi-position connector jack 102 and a circuit board 104. The circuit board 104 includes a top surface 106 and a side edge 108, and the connector jack 102 abuts the side edge 108 and extends over the top surface 106 of the board 104. With the multiple position connector jack 102, and for the reasons explained below, installation of the connector jack 102 is simplified and a greater density of connections to the jack 102 is facilitated with a lower profile to accommodate closer spacing of parallel circuit boards within a device and/or an overall lower profile of the device itself.

The connector jack 102 includes a shell 110 defining a top face 112, a bottom face 114, a front face 116 and a rear face 118. Solderable surfaces (not shown in FIG. 1 but described below) are formed on the shell 110 and project from a surface 120 overhanging the circuit board 104. The overhanging surface 120 is spaced from and located between the front and rear faces 116 and 118, and extends generally parallel to the top and bottom faces 112 and 114. An abutment face 122 is also formed in the shell 110 and abuts or aligns with the edge 108 of the circuit board 104. The abutment face 122 interconnects the overhanging surface 120 and the bottom face 114. The overhanging surface 120 extends inwardly from the rear face 118 to the abutment face 122, and consequently the solderable surface formed on the overhanging surface 120 does not extend entirely between the front and rear faces 116, 118 of the shell 110. Rather, the overhanging surface 120, and the accompanying solderable surface extends only partially or incompletely between the front and rear faces 116, 118. Collectively the overhanging surface 120 and the abutment face 122 form a stepped contour that receives the side edge 108 of the circuit board 104. The overhanging surface 120, via the solderable surface formed thereon, is soldered to the top surface 106 of the board 104, and the abutment face 122 rests against or aligns with the board side edge 108 in a stable position.

Interface ports 124 extend from the shell front face 116, and in an exemplary embodiment the interface ports 124 are RF coaxial connector ports having a conductive shell portion 126 and a signal conducting center contact pin 128. In one embodiment, the interface ports 124 are, for example, 50Ω interfaces constructed to mechanically and electrically connect to coaxial cables in a known manner. It is understood, however, that other types of interface ports and ports having various ratings and operating characteristics may likewise be employed in alternative embodiments. Additionally, while four interface ports 124 are illustrated in FIG. 1, it is understood that in alternative embodiments, the connector jack 102 may have greater or fewer numbers of interface ports 124.

A pair of board mounting flanges 130 are formed in the shell 110 opposite the interface ports 124, and the board mounting flanges 130 extend rearwardly and away from the shell rear face 118 in a direction opposite to the forwardly facing interface ports 124. Retention apertures 132 are provided proximate the board mounting flanges 130 to mechanically retain the shell 110 to the board 104 and support the connector jack 102 in a direction perpendicular to the board 104 as explained further below, and the board mounting flanges 130 mechanically support and position the shell to the board 104 in a predetermined position for soldering the shell 110 to the board 104.

A panel mounting flange 134 extends upwardly from the top face 112 of the shell 110 and is positioned between the board mounting flanges 130. The panel mounting flange 134 includes a retention aperture 136 for retaining the shell 110 to a panel (not shown) of, for example, a broadband video distribution device. The panel mounting flange 134 therefore provides support to the connector assembly 100 in a direction parallel to the board 104. While one panel mounting flange 134 and two board mounting flanges 130 are illustrated in FIG. 1, it is recognized that varying numbers of panel mounting flanges and board mounting flanges could be provided in different embodiments of the invention.

Figure 2:
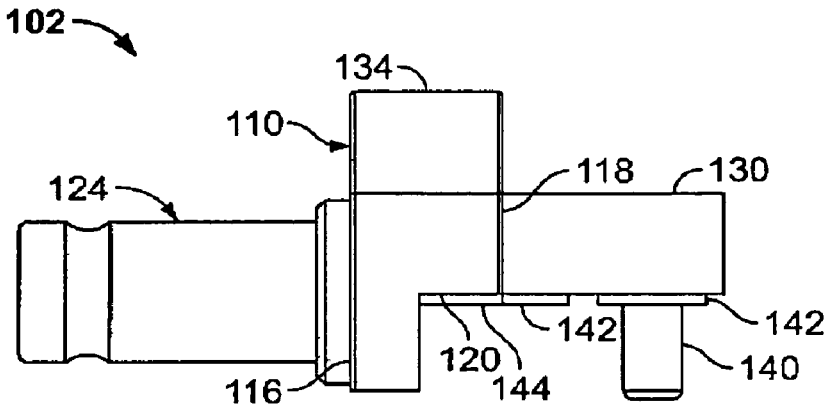
FIG. 2 is a side elevation view of the connector shown in FIG. 1.

FIG. 2 is a side elevation view of the connector assembly 100 removed from the board 104 (FIG. 1). The interface ports 124 extend axially and outwardly from the front face 116 of the shell 110, while the board mounting flanges 130 extend axially and outwardly from the rear face 118 of the shell 110. That is, the board mounting flanges 130 extend from the shell 110 in a direction opposite to the interface ports 124.

Figure 3:
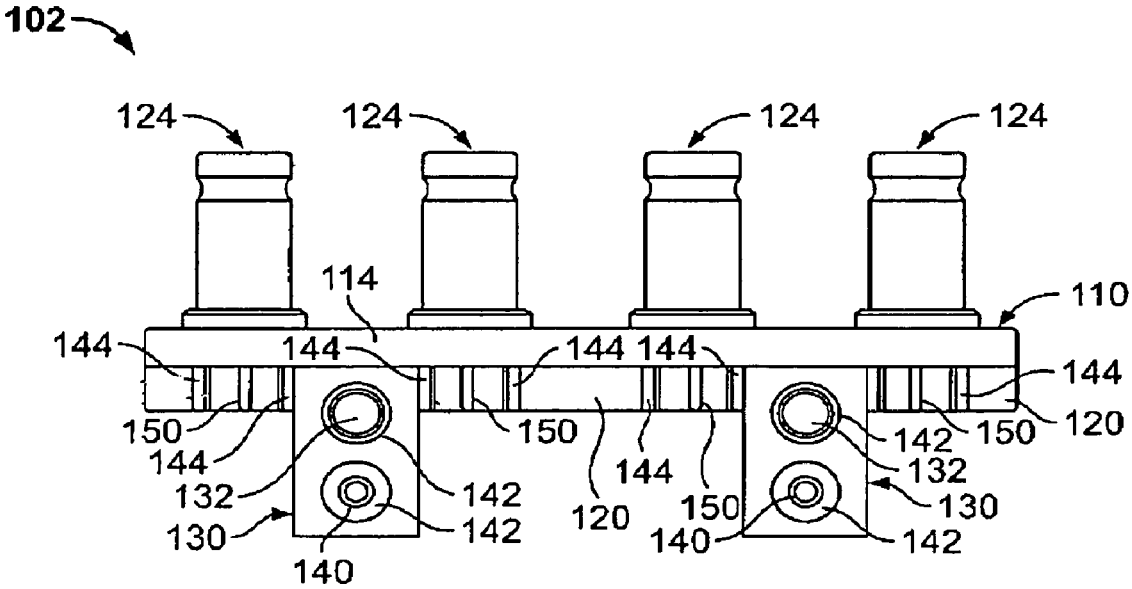
FIG. 3 is a bottom plan view of the connector shown in FIGS. 1 and 2.
Figure 5:
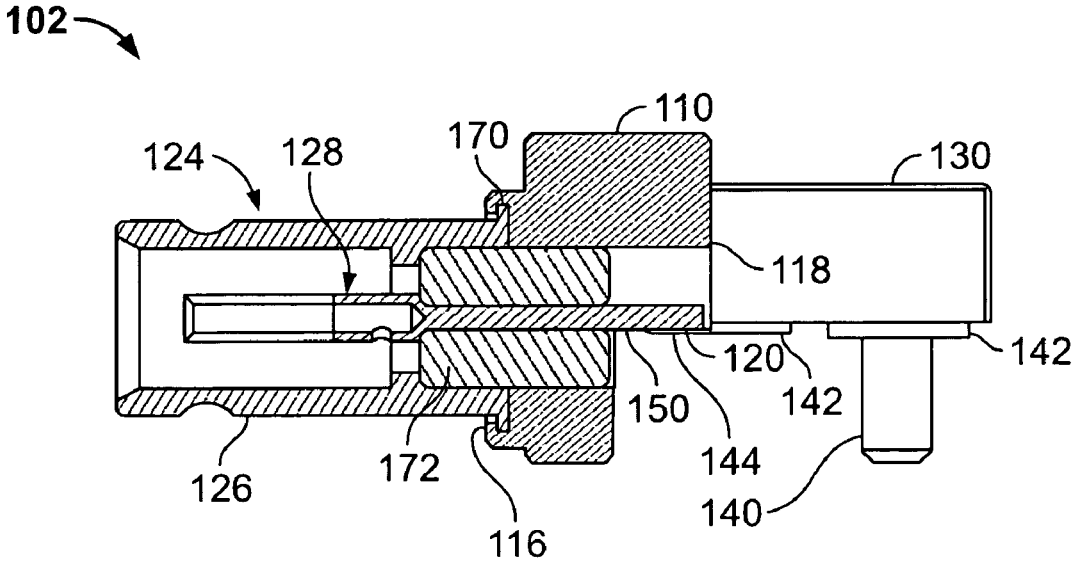
FIG. 5 is a cross sectional view of the connector taken along line 5—5 in FIG. 4.

As best shown in FIGS. 2, 3 and 5, the mounting flanges 130 in an exemplary embodiment each include a guide pin 140 extending downwardly from the mounting flange 130 and spaced apart from the shell rear face 118 at a predetermined distance. The mounting guide pins 140 project from the shell 110 in a substantially perpendicular direction to an axis of the center contact pins 128, or alternatively, in a substantially perpendicular or normal direction to the top surface 106 of the board 104. The guide pins 140 are dimensioned for slip fit insertion into complementary through-holes in the circuit board 104 to position the connector jack 102 relative to the board 104 and align the solderable surface on the overhanging surface 120 with solder pads on the top surface 106 of the circuit board when the connector jack 102 is installed.

Two shoulders 142 are provided in each board mounting flange, and in an exemplary embodiment one support shoulder 142 in each flange surrounds an intersection of the guide pin 140 and a lower surface of the board mounting flange 130, and the other support shoulder 142 projects from a lower surface of the board mounting flange 130 and encircles the retention aperture 132. In use, the support shoulders 142 provide a bearing surface for abutment with the top surface 106 (FIG. 1) of the board 104. Solderable surfaces 144 project from the overhanging surface 120 and are slightly recessed relative to the bearing surfaces of the support shoulders 142 such that when the bearing surfaces are in surface contact with the board top surface 106, the solderable surfaces are slightly spaced from the board top surface 106. In such a manner, the solderable surfaces 144 may be effectively suspended in a predetermined thickness of solder paste when installing the connector jack 102 to the board 104. Adequate mechanical and electrical connection in soldering operation, and uniformity and consistency of the soldered connections, is therefore assured.

FIG. 3 is a bottom plan view of the connector jack 102 illustrating additional features of the jack 102. Retention apertures 132 are provided in the mounting flanges 130 and are spaced from the guide pins 140 by a predetermined amount, and the retention apertures 132 are dimensioned to receive, for example, a screw or other fastener (not shown) for securing the shell 110 to the board 104 (FIG. 1).

With reference to FIGS. 3 and 5, an end 150 of each center contact pin 128 (FIG. 1) is exposed and is substantially coplanar with the solderable surfaces 144 of the shell 110. The pin ends 150 and the solderable surface 144 are soldered to respective signal and ground pads on the top surface 106 of the board 104, and as explained above, each of the pin ends 150 and the solderable surfaces 144 are slightly spaced from the board 104 and are suspended in solder paste to establish uniform and satisfactory solder connections to the board 104.

Figure 4:
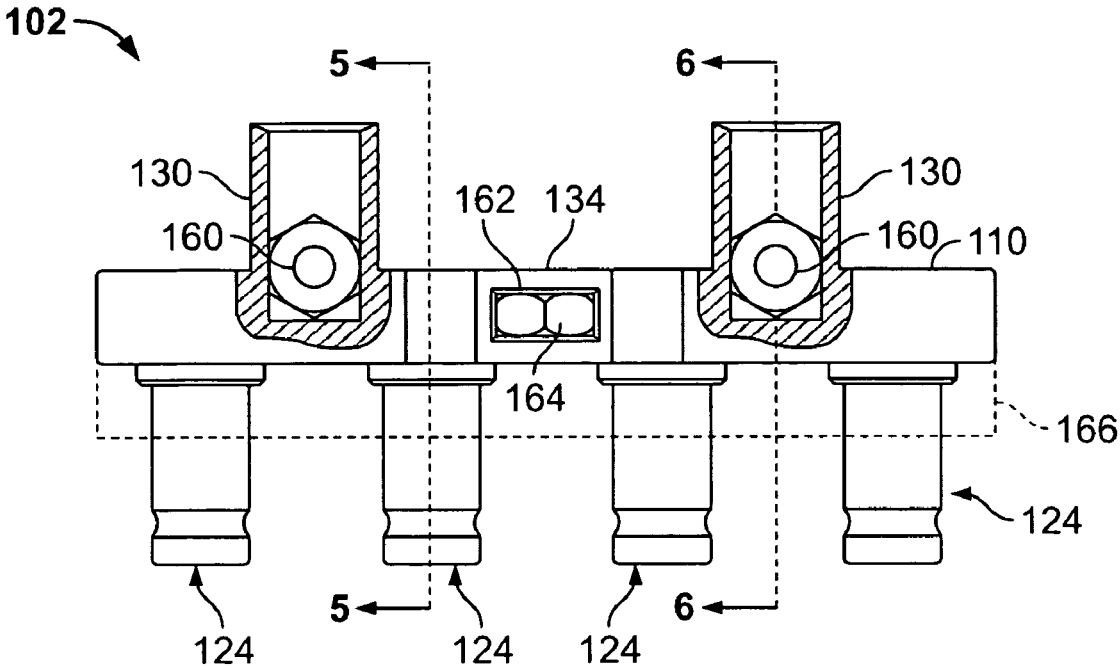
FIG. 4 is a top plan view partly broken away of the connector shown in FIGS. 1–3.
Figure 6:
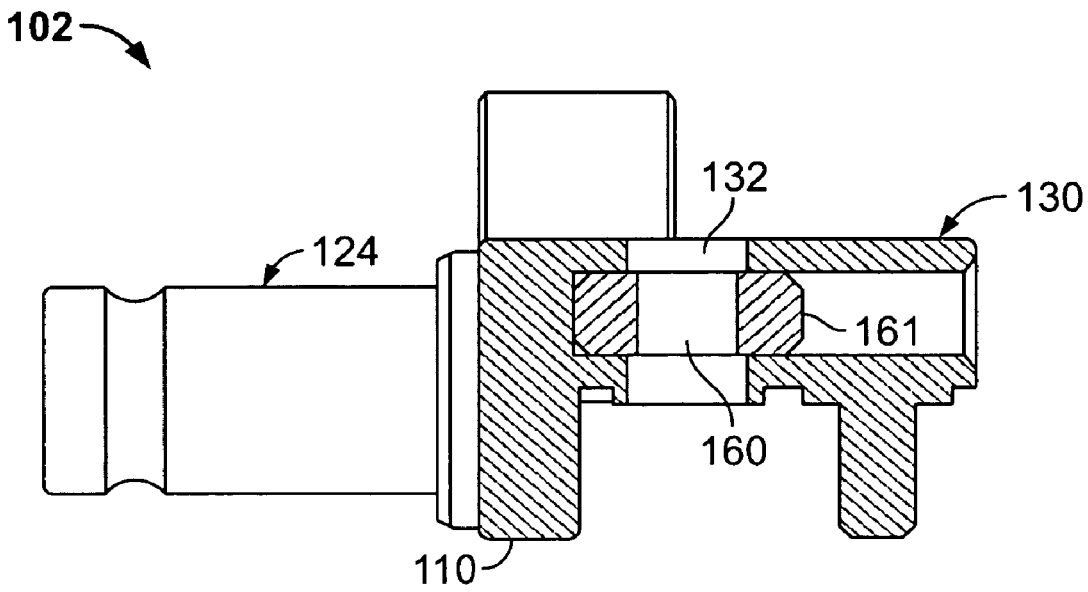
FIG. 6 is a cross sectional view of the connector taken along line 6—6 in FIG. 4.

FIG. 4 is a top plan view of the connector jack 102 with portions of the board mounting flanges 130 partly broken away. As best seen in FIGS. 4 and 6, a bore 160 is integrally formed with the shell 110 in each mounting flange 130. The bore 160 receives a female threaded fastener 161 (FIG. 6) integrally assembled into the shell 110, such as a hex nut, and the female fastener cooperates with a threaded fastener, such a screw, bolt, post or other fastener (not shown) inserted through the retention aperture 132 to secure the shell 110 to the board 104. The guide pins 140 and the bores 160 and the fasteners 161 allow the connector jack 102 to be mechanically connected to the board prior to soldering, thereby eliminating fixtures that would otherwise be required to hold the connector jack 102 in place on the board during soldering operations.

As also seen in FIG. 4, the panel mounting flange 134 also includes a bore 162 therein, and a female threaded fastener 164 such as a nut is integrally assembled into the shell 110 proximate the bore 162. In an exemplary embodiment, the mechanical fastener 161 in the board mounting flanges 130 and the mechanical fastener 164 in the panel mounting flange 134 are contained permanently within the shell 110 by cold forming the shell 110 in the aperture areas 110 and 136. The fasteners 161 and 164 are contained and not intended to be removed from the housing, but are able to float or move relative to the shell 110 for ease of alignment with threaded fasteners used to secure the shell 110 to the board 104. By integrally assembling the fasteners 161, 164 in the shell 110, installation of the connector jack 102 does not require separately provided female fasteners to install conventional jack connectors 102 to a board, and associated difficulties and problems of separately provided fasteners are avoided. Additionally, as shown in the Figures, four interface ports 124 may be mechanically mounted to the board 104 with only two fasteners 161, thereby dramatically reducing the number of fasteners required when compared to conventional discrete connectors individually fastened to the board.

The female fastener 164 in the panel mounting flange 134 co-operates with a threaded fastener, such a screw, bolt, post or other fastener (not shown) inserted through the retention aperture 136 (FIG. 1) to secure the panel mounting flange 134 to a panel 166 (shown in phantom in FIG. 4). Thus, in the illustrated embodiment, and by virtue of the integrally assembled fastener 164, the entire connector jack 102, including all of the interface ports 124, may be secured to the panel 166 with a significantly less installation time and cost compared to conventional discrete connectors that must be individually fastened to the panel 166.

FIG. 5 is a cross sectional view of the connector jack 102 taken through one of the interface ports 124, although the remaining interface ports 124 are constructed substantially similarly. The shell 110 is formed with an annular groove 170 adjacent the front face 116, and the shell portion 126 of the interface port 124 is retained in the annular groove 170. While the shell portion 126 is illustrated as being separately fabricated from the shell 110, it is appreciated that the shell portion 126 could be integrally formed with the shell 110 in another embodiment as desired.

The center contact pin 128 is positioned within the shell portion 126 and extends in a linear fashion without axial bends through the shell 110 wherein the end 150 of the pin 128 extends past the shell abutment face 122 and to the shell rear face 118, thereby exposing the pin end 150 on the-overhanging surface 120 in a substantially coplanar relation to the solderable surfaces 144. Because the pin 128 extends straight through the connector jack 102 and because the pin end 150 is exposed on the overhanging surface 120 and is coplanar with the solderable surface 144, the pin 128 may be connected to the board top surface 106 (FIG. 1) without right angle geometry in the signal conducting path. Thus, impedance matching problems associated with right angle geometry are avoided. Additionally, the exposed pin end 150 being substantially flush or coplanar with the solderable surfaces 144 and extending linearly through the shell 110 and shell portion 126 produces a much lower vertical profile of the connector jack 102 when installed to the board 104 than conventional connectors generally, and especially in comparison to conventional right angle connectors.

In accordance with known coaxial connectors a dielectric 172 substantially surrounds a portion of the center contact pin 128. In the illustrated embodiment, the dielectric 172 extends partly within the shell 110 and partly within the shell portion 126 of the interface port 124. The dielectric 172 is press fitted around the center contact pin 128 and within the shell 110 to insure a rigid coplanar assembly.

Figure 7:
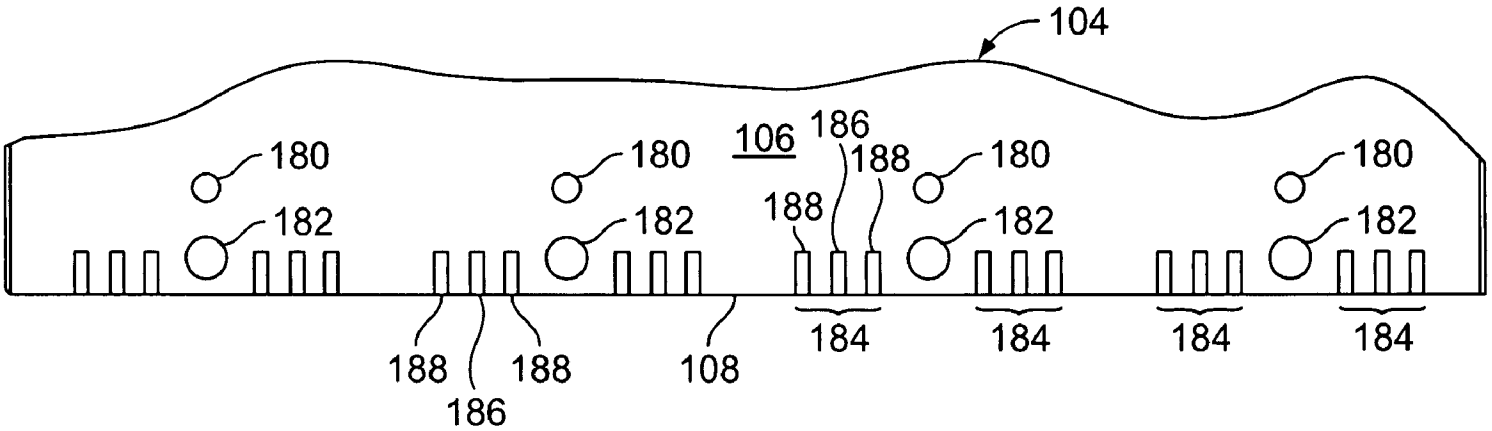
FIG. 7 is a top plan view of the circuit board shown in FIG. 1.

FIG. 7 is a top plan view of the circuit board 104, illustrating an exemplary layout for use with the connector jack 102. Guide through-holes 180 are provided in the board 104 for receiving the guide pins 140 (FIGS. 2 and 5), and fastener through-holes 182 are provided in the board 104 for receiving the threaded fasteners (not shown) that engage the fasteners 161 (FIG. 6) to secure the connector shell 110 to the board 104. Sets 184 of solder pads are provided adjacent the board edge 108 and on the board top surface 106. Each set 184 of solder pads includes a center signal pad 186 that establishes an electrical connection with the signal contact pin 128 in each interface port 124, and ground pads 188 on either side of the signal pad 186. The ground pads 188 establish electrical connection with solderable surfaces 144 of the jack 102. In one embodiment, the connector jack 102 is soldered only to top surface 106 of the board 104, thereby allowing flexibility in the design and circuitry on the board 104.

As illustrated in FIG. 7, adjacent sets 184 of solder pads are evenly spaced from one another, and adjacent through-holes 180, 182 in the board 104 are evenly spaced from one another, thereby providing a uniform pitch or center-to-center distance between the connector interface ports 124 when the connector jacks 102 are installed to the board 104. Because of the integrally assembled fasteners 161 (FIG. 6) in the connector board mounting flanges 130, and further because of the integrated multiple interface ports 124 of the connector jack 102, the pitch between adjacent interface ports 124 when installed to the board 104 is less than the pitch obtainable with conventional discrete connectors, and the interface density is therefore greater than has conventionally been possible.

Figure 8:
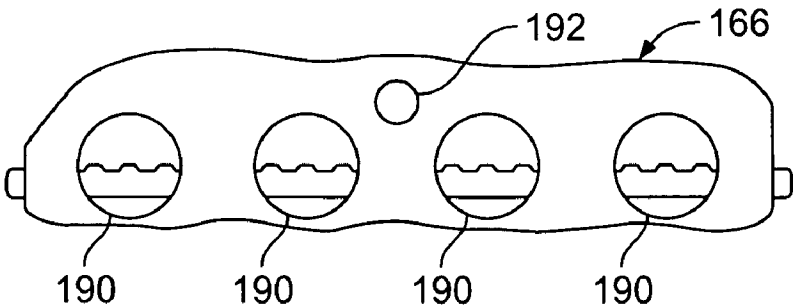
FIG. 8 is a front elevational view of an exemplary mounting panel that may be used with the connector assembly shown in FIGS. 1 and 2.

FIG. 8 is a front elevational view of an exemplary mounting panel 166 that may be used with the connector assembly 100 described above. The panel 166 may be connected to and supported by an equipment chassis, for example, in a known manner, and the panel 166 includes interface openings 190 that may be fitted over the interface ports 124 of the connector jack 102, and a mounting aperture 192 that may be aligned with the retention aperture 136 (FIG. 1) of the connector jack 102 when installed. When a male fastener is inserted through the aperture 192 and the retention aperture 136 and engaged to the female fastener 164 (FIG. 4) in the shell 110, the connector jack 102 may be quickly and easily mounted to the panel 166 with reduced installation time and expense in comparison to known connectors.

While the invention has been described in terms of various specific embodiments, those skilled in the art will recognize that the invention can be practiced with modification within the spirit and scope of the claims.

What is claimed is:

1. A connector assembly comprising:

a conductive shell defining multiple interface ports and a solderable surface configured to be surface mounted to a solder pad on a circuit board;

a center contact pin located in each respective interface port, wherein the center contact pin is substantially coplanar with the solderable surface, wherein the shell comprises at least one board mounting guide pin projecting transverse to an axis of the center contact pin, the board mounting guide pin configured to fit into a hole in the circuit board in order to align the solderable surface with the solder pad; and wherein the shell further comprises a panel mounting flange, a mounting aperture formed in the panel mounting flange, and a female threaded fastener contained in the panel mounting flange and aligned with the mounting aperture wherein a complementary threaded fastener can be inserted through the aperture and into engagement with the female threaded fastener for securing the connector assembly to a mounting panel.

2. The connector assembly of claim 1, wherein the shell comprises a front face and a rear face, the rear face having a stepped contour dimensioned to receive an edge of the circuit board, and each of the interface ports extend away from the front face.

3. The connector assembly of claim 1, wherein the shell comprises a front face and a rear face, at least one board mounting flange extending away from one of the front face and the rear face and having the board mounting guide pin formed thereon, and the interface ports extending away from the other of the front face and the rear face.

4. The connector assembly of claim 1, wherein the interface ports are coaxial connector ports.

5. A low profile connector assembly comprising:

a conductive shell comprising opposing front and rear faces, and solderable surfaces configured to be surface mounted to a circuit board with the solderable surfaces extending incompletely between the front and rear faces;

multiple coaxial interface ports extending from said shell, each of said ports comprising a center contact pin and a dielectric surrounding a portion of said pin;

wherein the center contact pins are substantially coplanar to the solderable surfaces, wherein the shell comprises at least one board mounting flange extending from the rear face, the board mount flange comprising a guide pin projecting substantially perpendicular to an axis of the coaxial interface ports, and the guide pin spaced from the rear face, the guide pin configured to fit into a hole in the circuit board; and wherein a mounting aperture is formed in the board mounting flange, and a female threaded fastener is contained in the board mounting flange and aligned with the mounting aperture, wherein a complementary threaded fastener can be inserted through the aperture and into engagement with the female threaded fastener for securing the connector assembly to the circuit board.

6. The low profile connector assembly of claim 5, wherein the shell further comprises a top face and a bottom face, the solderable surface being spaced from each of the top and bottom faces.

7. The low profile connector assembly of claim 5, wherein the shell further comprises a single panel mounting flange, at least one mounting aperture formed in the panel mounting flange, and at least one threaded fastener integrated into the panel mounting flange and permanently mounted thereto, thereby allowing all of the multiple coaxial interface ports to be coupled to a mounting panel via the panel mounting flange.

8. The low profile connector assembly of claim 5, wherein the female threaded fastener is configured to float relative to the shell in a vicinity of the mounting aperture.

9. A low profile coaxial connector assembly comprising:

a circuit board having a top surface and a side edge, the top surface having a plurality of solder pads adjacent the side edge;

a conductive shell configured to receive the side edge of the circuit board, the shell comprising opposing front and rear faces, and solderable surfaces configured to be surface mounted to the top surface of the circuit board, the solderable surfaces extending incompletely between the front and rear faces; and multiple coaxial interface ports extending from said shell, each of said ports comprising a center contact pin and a dielectric surrounding a portion of said pin;

wherein the coaxial interface ports extend outwardly from the side edge of the circuit board without utilizing right angle geometry to establish electrical connection to the solder pads, wherein the shell comprises at least one board mounting flange extending from the rear face, the board mounting flange comprising a guide pin projecting transverse to an axis of the coaxial interface ports, and the guide pin spaced from the rear face, the guide pin configured to fit into a hole in the circuit board;

wherein the shell comprises first and second board mounting flanges extending away from the rear face, and a panel mounting flange positioned between the board mounting flanges, wherein each of the board mounting flanges and the panel mounting flange comprise a female threaded fastener integrally assembled into the shell and permanently mounted thereto.

10. The low profile connector assembly of claim 9, wherein the shell further comprises a top face, a bottom face, and an overhanging surface extending between and spaced from the top and bottom surfaces, the solderable surfaces projecting from the overhanging surface.

* * * * *